United States Patent [19]

Shepherd

[11] 4,450,970

[45] May 29, 1984

[54] DISPLAY PANELS

[75] Inventor: Charles G. Shepherd, Oakville, Canada

[73] Assignee: J. A. Wilson Display Ltd., Mississauga, Canada

[21] Appl. No.: 332,092

[22] Filed: Dec. 17, 1981

[30] Foreign Application Priority Data

Sep. 11, 1981 [CA] Canada ..... 385666

[51] Int. Cl.[3] ..... A47B 47/00

[52] U.S. Cl. ..... 211/189; 52/36; 52/588; 211/90; 248/222.2

[58] Field of Search ..... 211/87, 189, 186, 90, 211/187, 183; 248/222.2, 222.3, 220.2, 73; 52/558, 36

[56] References Cited

U.S. PATENT DOCUMENTS

| | | | |
|---|---|---|---|
| 3,352,428 | 11/1967 | Sak et al. | 211/87 |
| 3,420,028 | 1/1969 | Barker | 52/588 |
| 3,698,565 | 10/1972 | Weber | 211/87 |
| 4,126,230 | 11/1978 | Tyson et al. | 211/189 X |
| 4,211,379 | 7/1980 | Morgan et al. | 248/222.2 |
| 4,323,163 | 4/1982 | Johns | 211/189 |

FOREIGN PATENT DOCUMENTS

| | | | |
|---|---|---|---|
| 2061548 | 7/1971 | Fed. Rep. of Germany | 211/87 |
| 2240992 | 3/1974 | Fed. Rep. of Germany | 248/222.2 |

*Primary Examiner*—Ramon S. Britts
*Assistant Examiner*—Robert W. Gibson, Jr.
*Attorney, Agent, or Firm*—Murray, Whisenhunt & Ferguson

[57] ABSTRACT

A display panel for displaying goods in a store is formed by elongate horizontal panel sections of sheet metal secured together in vertically superimposed positions. Each section has an intermediate portion extending from the top of a front wall to the bottom of a rear wall, a first channel formation at the top of the rear wall and a second channel formation at the bottom of the front wall. The first and second channel formations are interengaged to define recesses extending rearwardly from the front walls and upwardly behind the second channel formations, the recesses serving to engage conventional aperture board hooks or hooks and shelve units of novel design. The interengaged channel formations have surfaces connected in surface-to-surface contact with one another to reinforce the display panel.

13 Claims, 12 Drawing Figures

DISPLAY PANELS

FIELD OF THE INVENTION

The present invention relates to display panels and, more particularly to display panels forming parts of goods display units for use in stores.

BACKGROUND OF THE INVENTION

At the present time, it is common to display goods in a store by supporting them on conventional aperture board hooks which can be engaged at one end in a horizontal recess in a vertical display panel, which panel serves as an alternative to the use of a aperture board.

One such prior art display panel is formed by strips of veneered chipboard attached to a backing, the strips extending horizontally and being vertically spaced from one another, and the undersides of the strips being undercut, at the rear thereof, to form an elongate horizontal recess of L-shaped cross-section between each adjacent pair of the strips.

The conventional aperture board hooks in widespread use at the present time have a pair of upstanding prongs, which are engaged in the recesses, and a single downwardly extending prong which rests on the front face of the strip underlying the recess into which the hook is engaged.

This prior art display panel and hook arrangement has a number of disadvantages. Firstly, the veneered strips can be damaged by the hook, and in particular by the downwardly extending prong of the hook, particularly when relatively heavy articles are suspended from the hook, and the front faces of the veneered strips therefore have an appearance which tends to deteriorate relatively quickly. Furthermore, the veneer does not extend into the recesses between the strips, so that it is difficult to provide these recesses with an aesthetically pleasing or finished appearance.

The use of chipboard is disadvantageous because chipboard is heavy. The manufacture and assembly of the chipboard strips is also labour-intensive. In addition, the undercutting of the strips, which is done by routing, destroys the laminar balance of the material of the strips and the strips therefore tend to warp. This is particularly true when plywood is used.

Damage to the strips caused by warping or by the stresses exerted on the strips by the weighted hook cannot easily be repaired.

The strips must also be relatively bulky, since they need to be sufficiently thick to enable the undersides of the strips to be undercut to receive the two upstanding prongs on the hook yet, nevertheless, a sufficient thickness must be left at the bottom of each strip to withstand the stress exerted thereon by these upstanding prongs, and to fit the section of the conventional hooks, which tend to be pulled against the strips by the weight of the articles supported on the hook so as to exert a prying action on the strips.

It has previously been proposed to form a display panel from a single piece of sheet metal with a plurality of horizontally elongate upwardly open channel formations on the front face of the panel and to provide specially designed brackets for engagement with the channel formations for supporting goods therefrom. However, this previously proposed arrangement has the disadvantage that conventional aperture board hooks cannot be employed. A further disadvantage of this previously proposed arrangement is that substantial wastage occurs when it is necessary to cut the piece of sheet metal to size in order to adapt the display panel for a use of requiring a display panel of non-standard size.

Also, the upwardly open channel formations can collect dirt and other debris and therefore become unsightly after the panel has been in use for a period of time and the fit of brackets is interfered with.

OBJECTS OF THE INVENTION

It is accordingly an object of the present invention to provide a novel and improved display panel.

It is a further object of the present invention to provide a display panel assembled from a plurality of sections of sheet metal.

It is a further object of the present invention to provide an improved display panel which avoids the above-mentioned disadvantages of prior art display panels.

It is a further object of the present invention to provide a display panel which can be manufactured in different sizes without substantial wastage of material.

It is still a further object of the present invention to provide a display panel made of sheet metal which is reinforced so as to enable relatively thin sheet metal to be used.

BRIEF SUMMARY OF THE INVENTION

According to the present invention there is provided a display panel which comprises a plurality of elongate horizontal panel sections and means for securing the panel sections together in vertically superimposed positions, the panel sections being made of sheet metal. Each of the panel sections has a front wall portion, a rear wall portion and an intermediate portion extending from the top of the front wall portion to the bottom of the rear wall portion, with a first channel formation at the top of the rear wall portion and a second channel formation at the bottom of the front wall portion. Each of the panel sections, except the uppermost one, has the first channel formation thereof interengaged with the second channel formation of an adjacent overlying one of the panel sections to define therewith a recess extending rearwardly from the top of the front wall portion of the respective one of the panel sections and upwardly behind the second channel formation of the adjacent overlying one of the panel sections, the interengaged first and second channel formations having surfaces connected in surface-to-surface contact with one another to reinforce the display panel.

Since the display panel is built up from separate panel sections, it can readily be manufactured to a non-standard or non-modular size without substantial wastage of the sheet metal from which the panel sections are formed. The recesses defined by the interengaged channel formations can be shaped so as to be engageable by a standard aperture board hook although, as will be apparent from the following description, the invention also envisages the use of novel and simplified hooks and other accessories for engagement in the recesses.

BRIEF DESCRIPTION OF THE DRAWINGS

The invention will be more readily understood from the following description of preferred embodiments thereof given, by way of example, with reference to the accompanying drawing, in which:

FIG. 1 shows three panel section, indicated generally by reference numerals 30, forming part of a display panel.

Figure 1:
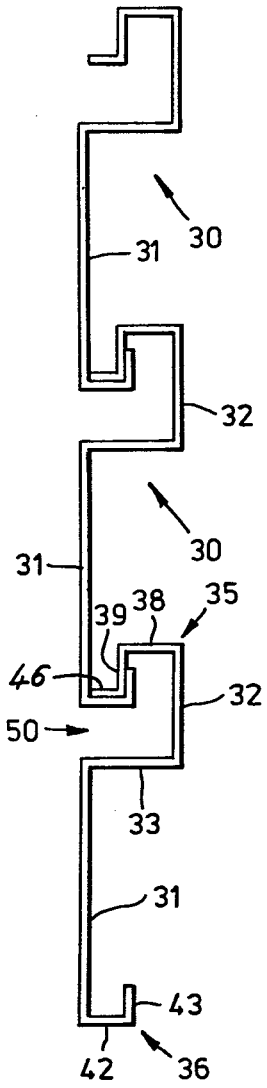
FIGS. 1, 2 and 3 show end views of parts of display panels according to three different embodiments of the present invention.

Each of the panel sections 30 is horizontally elongate and made of sheet steel and has a flat vertical front wall portion 31; a flat vertical rear wall portion 32 and a flat horizontal intermediate portion 33 which extends from the top of the front wall portion 31 to the bottom of the rear wall portion 32.

In addition, each of the panel sections 30 has a first channel formation, indicated generally by reference numeral 35, at the top of the rear wall portion 32 and a second channel formation, indicated generally by reference numeral 36, at the bottom of the front wall portion 31.

The first channel formation 35 is located above the intermediate portion 33 and is downwardly open towards the intermediate portion 33, and the second channel formation 36 is located below the intermediate portion 33 and is upwardly open towards the intermediate portion 33.

The first channel formation 35 is formed by a flat horizontal top portion 38 extending forwardly from the top of the rear wall portion 32 and a flat vertical depending portion 39 extending downwardly from the front of the top portion 38.

The channel formation is formed by a flat horizontal bottom portion 42 extending rearwardly from the bottom of the front wall portion 31 and a flat vertical upright portion 43 extending upwardly from the rear of the bottom portion 42.

As can be seen from FIG. 1, the first channel formation 35 of each panel section 30, except of course the uppermost panel section 30, is interengaged with the second channel formation of the adjacent overlying panel section 30.

More particularly, of each two interengaged panel sections 30, the upright portion 43 of the uppermost panel section 30 is engaged in the first channel formation 35 of the lower panel section 30 between the depending portion 39 and the rear wall portion 32 thereof with the front face of the upright portion 43 in surface-to-surface contact with the rear face of the depending portion 39.

In the embodiment of the invention illustrated in FIG. 1, each panel section 30 is also formed with a flat horizontal edge portion 46 extending forwardly from the bottom of the depending portion 39. At the interengaged channel formations 35 and 36, the edge portions 46 are in surface-to-surface contact with the bottom portions 42.

The channel formations 35 and 36, and the portions 39, 43 and 42, 46 which are held in surface-to-surface contact with one another by welding channels on the rear surface to strengthen the display panel against bending in the vertical and horizontal planes. This reinforcement enables the display panel to be made of relatively thin sheet steel, so that the material costs of the display panel are low and also the weight of the display panel is advantageously low.

Since the display panel is built up from individual panel sections 30, the display panel can be simply and economically manufactured with any one of a number of different height dimensions, as may be required by the end user of the display panel, so that the waste associated with prior art chipboard and plywood panels, which are generally limited to standard available sizes or modules thereof, is avoided.

The panel sections 30 are preferably provided with a baked on finish of a tough scratch resistant coating material, e.g. an epoxy material, which covers not only the front face of the front wall portion 31 but also the interior of the first channel formation 35 and the exterior of the second channel formation 36.

As can be seen from FIG. 1, the interengagement of the first and second channel formations 35 and 36 forms a recess, indicated generally by reference numeral 50, which extends rearwardly from between the front wall portions 31 of each adjacent pair of panel sections 30 and upwardly behind the second channel formation 36 of the upper of the pair of panel sections. This recess 50 is shaped for engagement by a standard aperture board hook, so that no specially designed and manufactured hook or other accessory is necessitated by the present display panel.

The panel sections 30 may be separately finished with coatings of different colours, to allow the display panel to be made with a multi-coloured pattern and/or with an upper and/or lower border of contrasting colours and riveted or screw-fastened to backing channels.

The flat horizontal edge portion 46 extends forwardly into abutment with the rear of the front wall portion of the adjacent panel section 30 to limit horizontal play or movement of the panel sections 30 and, more importantly, to add strength to the stress taking areas of the panel section.

As viewed from the front of the display panel, the edges of the sheet metal panel sections 30 are entirely concealed, and therefore no dangerous sheet metal edges are exposed. Furthermore, when pre-finished sheet material having a finished coating covering the front surface but not extending over the edge thickness of the sheet material is used to form the panel sections 30, the unfinished edges are not visible.

The above-described interengagement of the channel formations minimizes the need for structural backing support and, in fact, the display panel can be installed directly onto the wall of a building, by fastening to the wall through the rear wall portions 32, without backing strips of any kind when it is required to do so.

Figure 2:
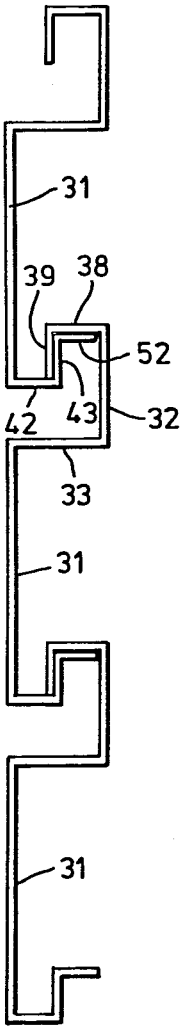
Figure 3:
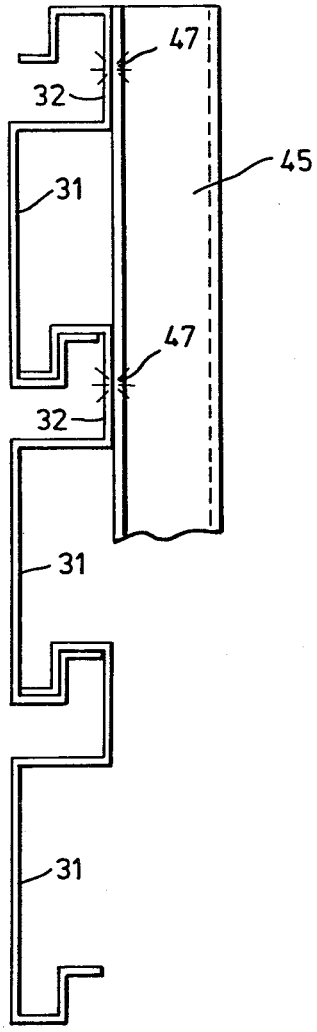

FIGS. 2 and 3 show modification of the display panel and, for convenience, the same reference numerals have been used in FIGS. 2 and 3 as in FIG. 1 to indicate the same parts.

It will be seen, however, that in the embodiment shown in FIG. 2 the flat horizontal edge portion 46 has been omitted, the depending portion 39 extending downwardly into abutment with the top of the bottom portion 42 of the adjacent panel section 30.

Also, each panel section 30 in FIG. 2 is provided with a flat horizontal rear edge portion 52 which, except in the case of the uppermost panel section 30, underlies and is in surface-to-surface contact with the underside of the top portion 38 of the adjacent panel section. The edge portion 52 extends rearwardly from the top of the upright portion 43 into abutment with the front surface of the rear wall portion 32.

In the embodiment shown in FIG. 3, both of the edge portions 46 and 52 are provided.

The panel sections 30 of FIGS. 1, 2 and 3, assembled as described above to form display panels, are in use secured together by welding the rear wall portions 32 of the panel sections to back stiffeners, which may take different forms depending upon whether the display panels are to be mounted on a wall or used as panel inserts in floor fixtures, e.g. gondolas.

Figure 4:
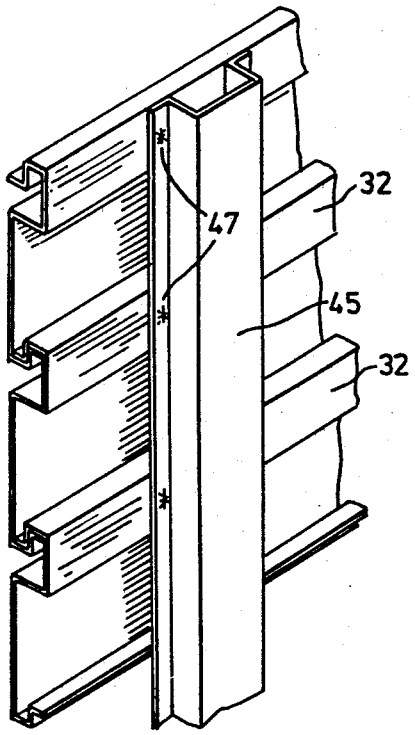
FIG. 4 shows a broken-away view in perspective of the panel parts shown in FIG. 3.

FIGS. 3 and 4 show one such back stiffener in the form of a vertical metal channel member 45 secured by spot welds 47 to the rear wall portions 32 and it is to be understood that the channel member 45 may alternatively be similarly spot welded to the panel portions of FIGS. 1 or 2.

Figure 5:
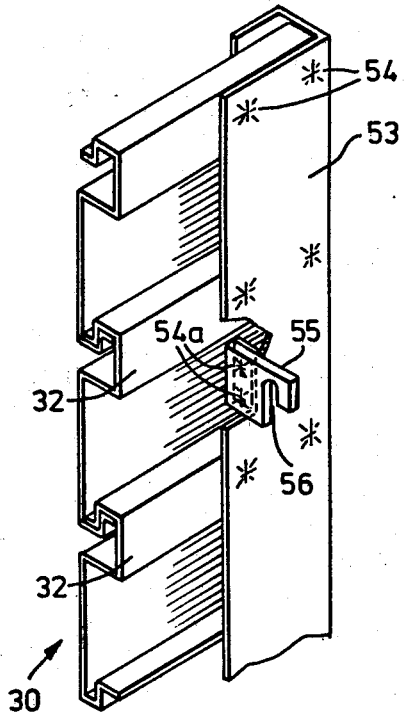
FIG. 5 shows, a broken-away view in perspective of the panel parts of FIG. 1 with an end cover member added.

FIG. 5 shows a vertical end cover in the form of a metal channel member 53 engaged around the ends of the panel sections 30 of FIG. 1 and secured to the rear wall portions 32 thereof by spot welds 54.

A support bracket 55, formed with an upwardly extending slot 56, is fixed by a spot weld **54*a* to a lug (not shown) formed by an inturned portion of the channel member 53**.

The support bracket 55 is interengageable with a corresponding support bracket 57 (FIG. 6) welded to a bent lug 58 on a metal standard 59, the bracket 57 being engageable in the slot 56.

The metal channel member 53 is one of a pair of end covers of which only one is shown, which are engaged over opposite ends of the panel sections 30 and welded thereto for engagement in the above-described manner with correspondingly located support brackets 57, only one of which is shown, on a floor fitting of otherwise conventional construction.

Figure 7:
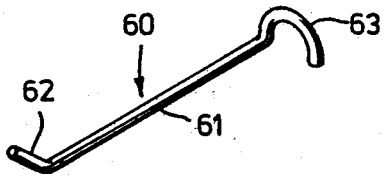
FIG. 7 shows a novel hook for use with the display panels of FIGS. 1 to 3.

FIG. 7 shows a novel and simplified support member in the form of a hook, indicated generally by reference numeral 60, which is made in one piece from a single piece of metal rod material and which can be used with the above-described display panels instead of a conventional standard aperture board hook, which is made of two pieces welded together.

The hook 60 has a straight shank 61 with an upturned end 62 at one end thereof.

The other end of the hook 60 is bent to form a curved end portion 63 extending laterally of the shank 61 in a plane transverse to the longitudinal direction of the shank 61.

Figure 8:
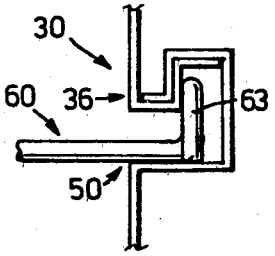
FIG. 8 shows a broken-away view, in side elevation, of the hook or FIG. 7 engaged in the display panel of FIG. 1.

When the hook 60 is in use, as shown in FIG. 8, curved end portion 63 is inserted into the recess 50 so as to extend upwardly behind and into engagement with the second channel formation 36 of the uppermost of the panel sections joined at the recess 50, so that the hook 60 is thereby releaseably retained in the recess 50 in the display panel.

Figure 6:
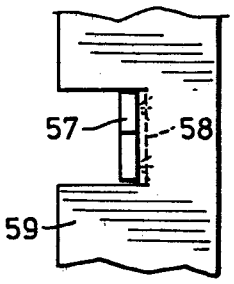
FIG. 6 shows a view in elevation of a support bracket arrangement for co-operation with the end cover member of FIG. 5.
Figure 9:
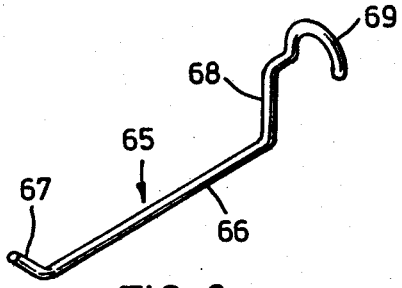
FIG. 9 shows a modification of the hook of FIG. 7.
Figure 10:
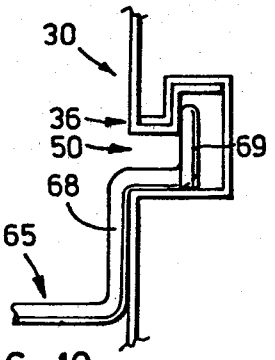
FIG. 10 shows a broken-away view, in side elevation, of the hook of FIG. 9 engaged in the display panel of FIG. 1.

FIGS. 9 and 10 show a hook, indicated generally by reference numeral 65, which is a modification of the hook 60 of FIGS. 5 and 6.

The hook 65 has a straight shank 66, and an upwardly bent end portion 67 at one end thereof.

At the other end of the shank 66, there is provided a upwardly and rearwardly bent portion 68 extending at right angles to the shank 66 and connecting the shank 66 to a curved end portion 69 corresponding to the curved end portion 63 of the hook 60.

The curved end portion 69 is engageable in the recess 50 as shown in FIG. 8, from which can be seen that the transverse portion 68 extends downwardly from the mouth of the recess 50, so that the shank 66 is supported at a spacing below the recess 50. This enables articles to be supported at a level spaced between the levels at which the articles can be supported by the hooks 60.

Figure 11:
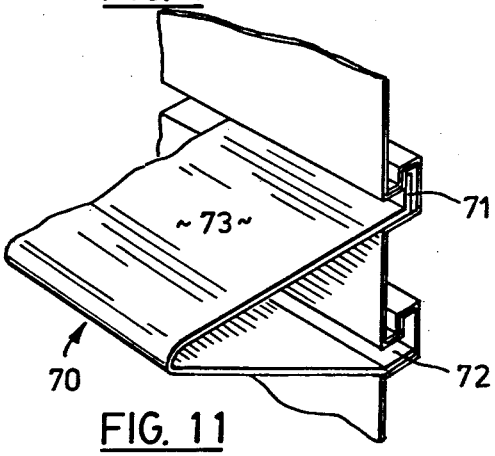
FIG. 11 shows a broken-away view in perspective of a shelf engaged in the display panel parts of FIGS. 1, 2 or 3.

FIG. 11 shows a support member in the form of a shelf unit indicated generally by reference numeral 70, for use with the display panel of any one of FIGS. 1 to 3.

The shelf unit 70, which may be made of sheet metal or plastics material, has an upwardly projecting L-shaped edge portion or flange 71 for engagement through one of the recesses 50, the flange 71 serving as a hook for retaining the shelf unit 70 relative to the display panel, and a lower edge portion 72 which is simply slid into the underlying recess 50.

The flange 71 is provided at the edge of a top surface 73 of the shelf unit 70 and the top surface 73 may, if desired, be transversely embossed for reinforcement.

The shelf unit 70 does not require any additional hooks or other fasteners for securing it to the display panel.

Figure 12:
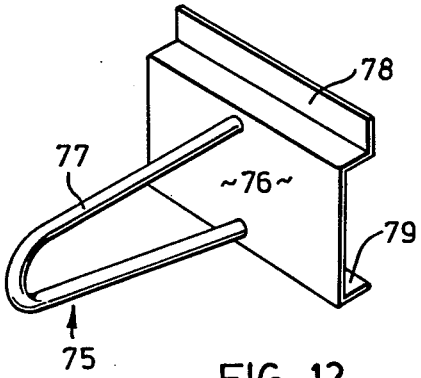
FIG. 12 shows a view in perspective of a heavy duty hook for use with the display panel parts of FIGS. 1, 2 or 3.

FIG. 12 shows a heavy duty hook, indicated generally by reference numeral 75, which has a base plate or bracket 76 from which extends forwardly a V-shaped support 77 of metal rod.

The base plate 76 is provided, at its top, with an upwardly projecting L-shaped flange 78 for insertion through one of the recesses 50 into engagement with and behind the respective second channel formation 36 and, at its bottom, with a flat edge flange 79 for engagement in the underlying recess 50.

The heavy duty hook distributes its load over a wide area of the display panel and thus prevents point loads and stress damages.

The base plate 76 may be used as a fastening means for hooks, brackets and shelf devices of many configurations. The lower flange 79 may be omitted.

I claim:

1. A display panel, comprising:

a plurality of elongate horizontal panel sections and means for securing said panel sections together in vertically superimposed positions;

said panel sections being made of sheet metal and each comprising:

a front wall portion;

a rear wall portion spaced rearwardly from said front wall portion;

an intermediate portion extending from the top of said front wall portion to the bottom of said rear wall portion;

a first channel formation at the top of said rear wall portion; and a second channel formation at the bottom of said front wall portion;

each of said panel sections except the uppermost one having said first channel formation thereof interengaged with said second channel formation of an adjacent overlying one of said panel sections defining therewith a recess extending rearwardly from the top of said front wall portion of the respective one of said panel sections and upwardly behind said second channel formation of said adjacent overlying one of said panel sections; and said interengaged first and second channel formations having surfaces connected in surface-to-surface contact with one another to reinforce said display panel.

2. A display panel as claimed in claim 1, wherein said surfaces in surface-to-surface contact with one another extend horizontally and vertically for reinforcing said display panel in the horizontal and vertical directions.

3. A display panel as claimed in claim 1, wherein said surfaces in surface-to-surface contact comprise a pair of vertical surfaces disposed between and spaced from said front and rear wall portions and a pair of horizontal surfaces extending transversely of said display panel within one of said interengaged first and second channel formations.

4. A display panel as claimed in claim 3, wherein said surfaces in surface-to-surface contact include a further pair of horizontal surfaces extending transversely of said display panel within the other of said interengaged first and second channel formations.

5. A display panel as claimed in claim 1, provided with a support member for attachment to said panel sections, said support member comprising an elongate shank portion and a bent end portion at one end of said shank portion and extending laterally of said shank portion for insertion through any of said recesses into engagement with and behind the corresponding one of said second channel formations for releasably retaining the support member.

6. A display panel as claimed in claim 5, wherein said support member further includes an intermediate portion extending upwardly and rearwardly from said shank portion to said end portion.

7. A display panel as claimed in claim 1, provided with a support member for attachment to said panel sections, said support member having a first upwardly projecting edge portion for insertion through one of said recesses into engagement with and behind the corresponding one of said second channel formations and a second edge portion for insertion into an underlying one of said recesses.

8. A display panel as claimed in claim 7, wherein said support member comprises a shelf and is made in one piece and of sheet metal.

9. A display panel as claimed in claim 8, wherein said first and second edge portions are parts of a sheet metal bracket, said support member further comprising a metal rod support projecting forwardly from said bracket.

10. A display panel, comprising:

a plurality of elongate horizontal panel sections and means for securing said panel sections together in vertically superimposed positions;

said panel sections being made of sheet metal and each comprising:

a flat vertical front wall portion;

a flat vertical rear wall portion spaced rearwardly from said front wall portion;

a flat horizontal intermediate portion extending rearwardly from the top of said front wall portion to the bottom of said rear wall portion;

a first channel formation at the top of said rear wall portion;

said first channel formation being above and downwardly open towards said intermediate portion; and a second channel formation at the bottom of said front wall portion;

said second channel formation being below and upwardly open towards said intermediate portion;

each of said panel sections except the uppermost one having said first channel formation thereof interengaged with said second channel formation of an adjacent overlying one of said panel sections defining therewith a recess extending rearwardly from the top of said front wall portion of the respective one of said panel sections and upwardly behind said second channel formation of said adjacant overlying one of said panel sections; and said interengaged first and second channel formations having surfaces connected in surface-to-surface contact with one another to reinforce said display panel.

11. A display panel as claimed in claim 10, wherein said first channel formation comprises a flat horizontal top portion extending forwardly from the top of said rear wall portion and a vertical depending portion extending downwardly from the front of said top portion, and said second channel formation comprises a horizontal bottom portion extending rearwardly from the bottom of said front wall portion and a vertical upright portion extending upwardly from the rear of said bottom portion, said surfaces in surface-to-surface contact being surfaces of said depending and upright portions.

12. A display panel as claimed in claim 11, wherein said first channel formation includes a flat horizontal edge portion extending forwardly from the bottom of said depending portion, said surfaces in surface-to-surface contact including mutually contacting surfaces of said edge portion and said bottom portion.

13. A display panel as claimed in claim 11, wherein said second channel formation includes a flat horizontal edge portion extending rearwardly from the top of said upright portion, said surfaces in surface-to-surface contact including mutually contacting surfaces of said edge portion and said top portion.

* * * * *